US006932671B1

(12) United States Patent
Korovin et al.

(10) Patent No.: US 6,932,671 B1
(45) Date of Patent: Aug. 23, 2005

(54) METHOD FOR CONTROLLING A CHEMICAL MECHANICAL POLISHING (CMP) OPERATION

(75) Inventors: Nikolay Korovin, Phoenix, AZ (US); Stephen Schultz, Gilbert, AZ (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 10/840,066

(22) Filed: May 5, 2004

(51) Int. Cl.[7] ..... B24B 49/00
(52) U.S. Cl. ..... 451/5; 451/41
(58) Field of Search ..... 451/5, 8, 41; 438/692, 438/693

(56) References Cited

U.S. PATENT DOCUMENTS 6,350,179 B2 * 2/2002 Campbell et al. ..... 451/41
6,827,629 B2 * 12/2004 Kim et al. ..... 451/5
2003/0087459 A1 * 5/2003 Laursen et al. ..... 438/8
2005/0026542 A1 * 2/2005 Battal et al. ..... 451/5

* cited by examiner

*Primary Examiner*—Dung Van Nguyen
(74) *Attorney, Agent, or Firm*—Ingrassia Fisher & Lorenz PC

(57) ABSTRACT

A method is provided for controlling a chemical mechanical polishing (CMP) operation. The method is operative in a CMP apparatus having a plurality of end point detection probes and in which a plurality of process variables can be set to adjust the removal rate across a layer that is to be polished. In accordance with the method, the process variables are adjusted to a first setting and a layer overlying a work piece is polished using that setting. Information from the plurality of end point detection probes is collected and evaluated to determine removal rate of the layer. The process variables are adjusted in response the evaluation and a second layer on a second work piece is polished using the adjusted settings.

21 Claims, 5 Drawing Sheets

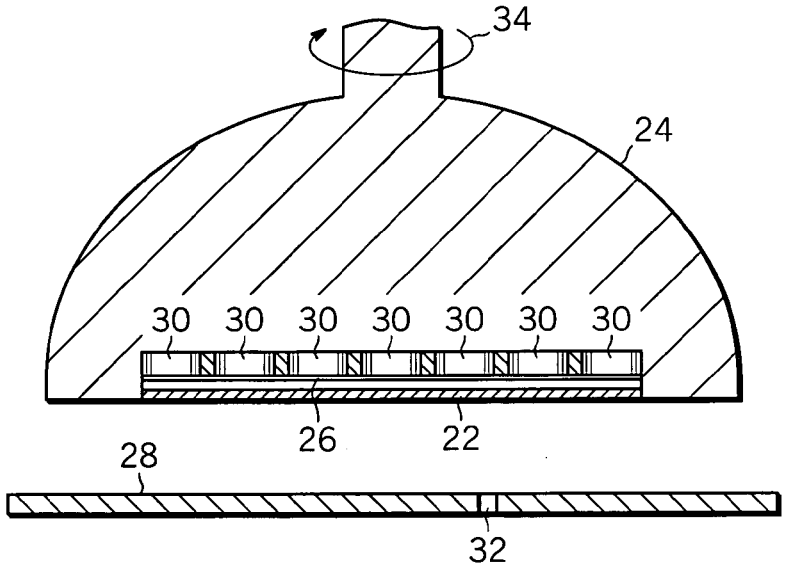
20
FIG. 1
FIG. 2
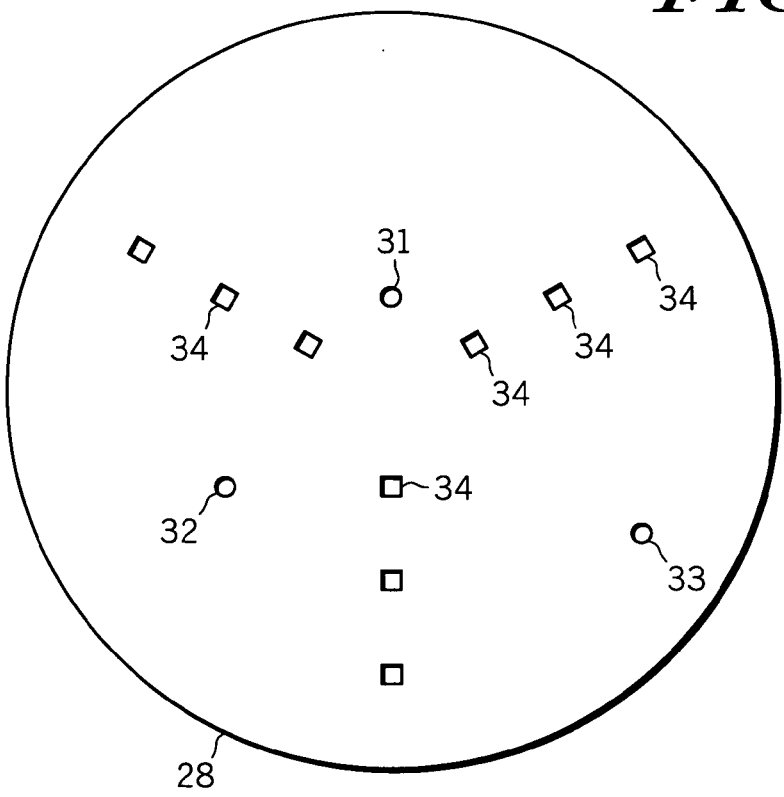

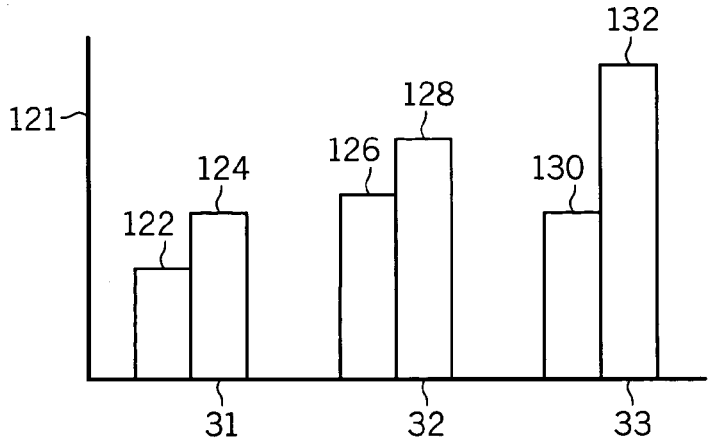
FIG. 6
FIG. 7
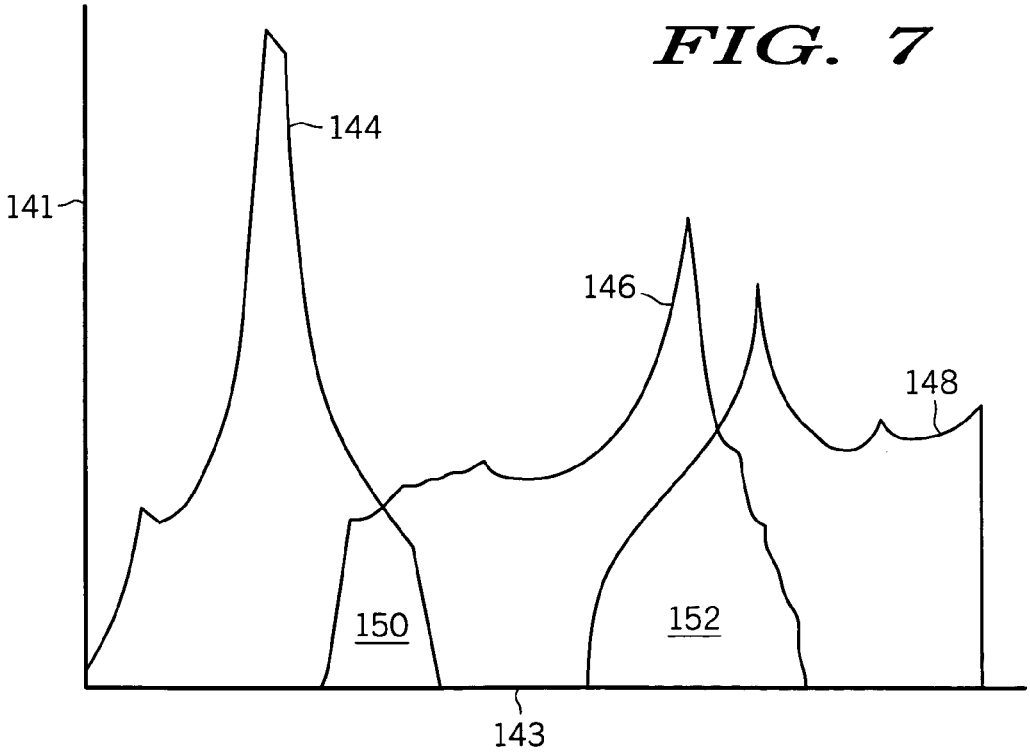

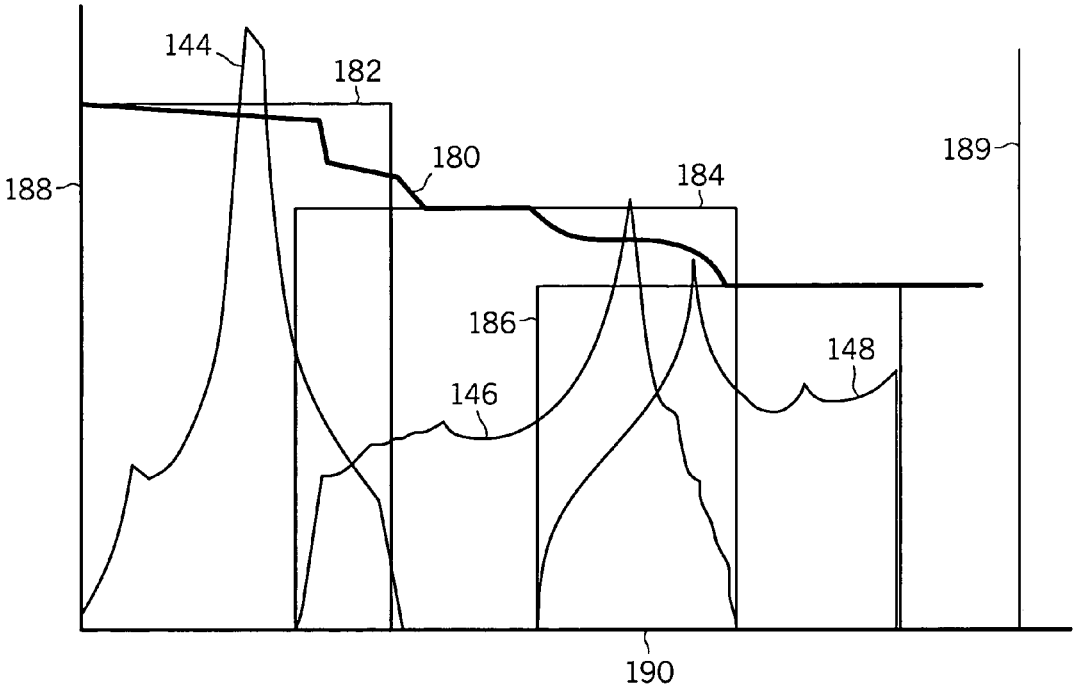
FIG. 8
FIG. 9
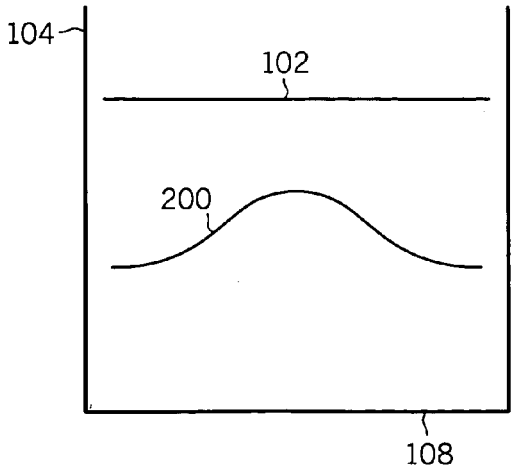

METHOD FOR CONTROLLING A CHEMICAL MECHANICAL POLISHING (CMP) OPERATION

TECHNICAL FIELD

The present invention generally relates to controlling a chemical mechanical polishing (CMP) operation utilizing information from an end point detection system, and more particularly, in one embodiment, to controlling a CMP operation run to run using end point detection feedback.

BACKGROUND

The manufacture of many types of work pieces requires the substantial planarization of at least one surface of the work piece. Examples of such work pieces that require a planar surface include semiconductor wafers, optical blanks, memory disks, and the like. One commonly used technique for planarizing the surface of a work piece is the chemical mechanical polishing (CMP) process, a process commonly practiced in a multi-zonal processing apparatus. In the CMP process a work piece, held by a work piece carrier head, is pressed against a polishing pad and relative motion is initiated between the work piece and the polishing pad in the presence of a polishing slurry. The mechanical abrasion of the surface combined with the chemical interaction of the slurry with the material on the work piece surface ideally produces a surface of a desired shape, usually a planar surface. The terms "planarization" and "polishing," or other forms of these words, although having different connotations, are often used interchangeably by those of skill in the art with the intended meaning conveyed by the context in which the term is used. For ease of description such common usage will be followed and the term "chemical mechanical polishing" will generally be used herein with that term and "CMP" conveying either "chemical mechanical planarization" or "chemical mechanical polishing." The terms "planarize" and "polish" will also be used interchangeably.

The construction of the carrier head of a CMP apparatus and the relative motion between the polishing pad and the carrier head as well as other process variables have been extensively engineered in an attempt to achieve a desired rate of removal of material across the surface of the work piece and hence to achieve the desired surface shape. For example, the carrier head generally includes a flexible membrane that contacts the back or unpolished surface of the work piece and accommodates variations in that surface. A number of pressure chambers are provided behind the membrane so that different pressures can be applied to various zones on the back surface of the work piece to cause desired variations in polishing rate across the front surface of the work piece.

End point detection probes are often used to detect the completion of a polishing operation. The completion of the polishing operation is signaled, in accordance with a detection algorithm, as a function of the remaining material thickness. Upon detection of the end point signal, the CMP operation is either terminated immediately or after some prescribed delay denoted as an "over polish time." In order to increase the detection coverage area on the work piece, a plurality of end point detection probes can be used. When using a plurality of probes, the CMP operation is terminated after end point detection signals are received from all of the probes. The use of a multi-zone carrier head in conjunction with a plurality of end point detection probes can improve CMP results if, upon receipt of a signal from one of the end point detection probes, the pressure in one or more of the particular zones of the carrier head is reduced, thereby locally reducing the polishing pressure. This approach, however, has a number of deficiencies. For example, some of the zones in the carrier head may be pressurized to their full pressure while an adjacent zone is at zero pressure. The severe pressure gradient between zones creates a significant stress on the surface of the work piece being polished and can damage structures on the work piece surface. In addition, the relative motion between the carrier head and the polishing pad is intentionally randomized to aid in achieving the desired polishing profile across a work piece. Because of the randomized motion, there is no direct correlation between the area on the work piece surface being monitored by a particular end point detection probe and the area controlled by a specific zone of the carrier head.

In many applications of chemical mechanical polishing, it is desirable to serially process a large number of work pieces, each of which may have similar surface characteristics. For example, in the semiconductor industry lots of twenty or more semiconductor wafers may be serially processed through a given CMP apparatus. Each of the wafers in the lot will be in a similar process state. For example, each of the wafers in the lot may have just had a layer of material such as layer of copper or other material deposited on one surface. A single piece of deposition equipment will have been used to deposit the layer on each of the wafers. The layer will have relatively uniform characteristics, such as thickness and deposition profile, from wafer to wafer, and those characteristics will be a function of the particular deposition equipment.

The CMP operation ideally achieves the desired shape across an individual work piece and from work piece to work piece within a lot. The CMP processing of work pieces can be a slow process, especially because the work pieces must be processed individually rather than in batches. To achieve a high throughput for the CMP operation, with desired processing results, a method is required that provides reliable run to run controls.

Accordingly, it is desirable to provide a method for controlling a CMP operation. In addition, it is desirable to provide a method for controlling the process variables in a multi-variable CMP operation, and especially to provide a method for controlling a CMP operation from run to run, that is, from work piece to work piece. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures, wherein like numerals denote like elements, and wherein FIG. 1 schematically illustrates, in cross section, a chemical mechanical polishing (CMP) apparatus;

FIG. 2 illustrates, in plan view, a polishing pad of a CMP apparatus and the positioning of a plurality of end point detection probes on the pad;

FIG. 6 illustrates, in bar graph form, a comparison of possible results for each of three end point detection probes;

FIG. 7 illustrates graphically a radial distribution of end point detection probe sampling density;

FIG. 8 illustrates graphically a continuous time correction coefficient; and FIG. 9 illustrates graphically a reconstructed actual removal rate profile.

DETAILED DESCRIPTION

Figure 3:
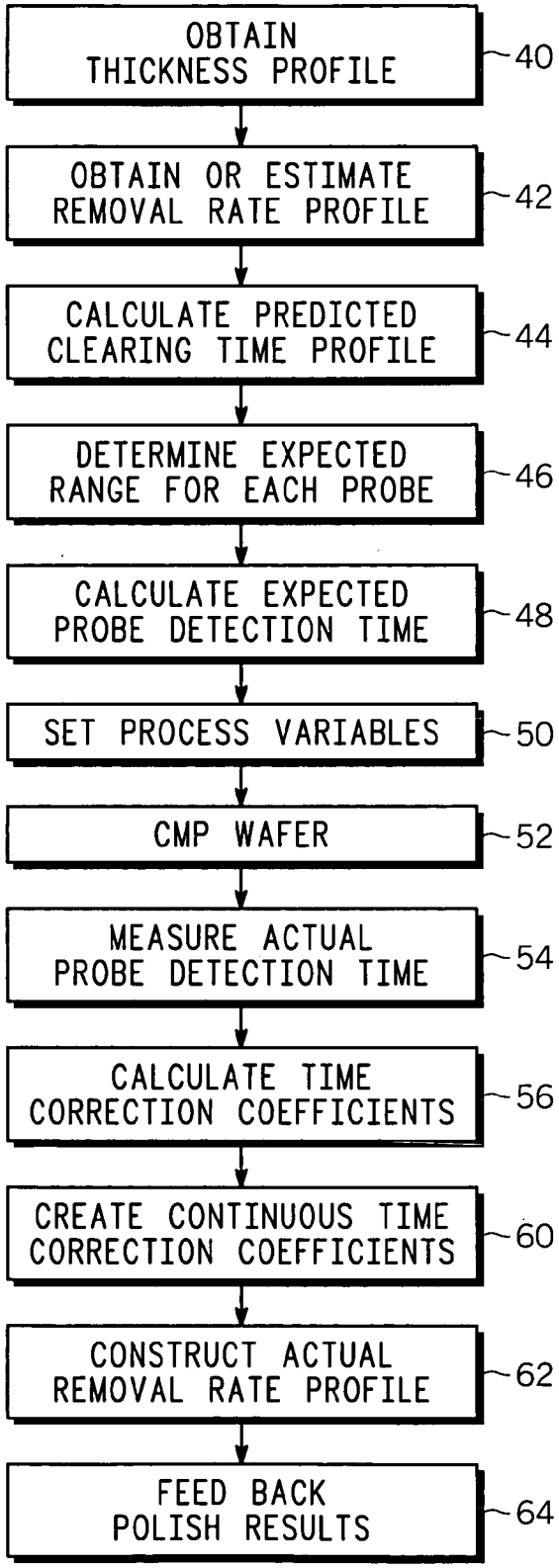
FIG. 3 illustrates, in flow chart form, a method for controlling a CMP operation in accordance with an embodiment of the invention.

The following detailed description is merely exemplary in nature and is not intended to limit the invention or the application and uses of the invention. Furthermore, there is no intention to be bound by any expressed or implied theory presented in the preceding technical field, background, or the following detailed description. Without loss of generality, but for ease of description and understanding, the following description of the invention will focus on applications to only one specific type of work piece, namely a semiconductor wafer. The invention, however, is not to be interpreted as being applicable only to semiconductor wafers. Those of skill in the art will instead recognize that the inventive method can be applied to any generally disk shaped work pieces.

FIG. 1 schematically illustrates, in cross section, a chemical mechanical polishing (CMP) apparatus 20 with which a surface of a work piece such as a semiconductor wafer 22 can be polished. The CMP apparatus includes a wafer carrier head 24 having a recess on its lower side that controls the positioning of the wafer. Integral with the carrier head is a wafer diaphragm 26 that presses against the back surface of the wafer. Pressure against the back surface of the wafer causes the front surface of the wafer, the surface that is to be polished, to be pressed against a polishing pad 28. A plurality of plenums 30, generally concentric plenums, is provided behind wafer diaphragm 26. The plurality of plenums can be individually pressurized to control the localized pressure exerted against the back surface of semiconductor wafer 22. Although four plenums are illustrated, an actual CMP apparatus may include a greater or lesser number of plenums. A plurality of end point detection probes (only one end point detection probe 32 is illustrated in this view) is positioned either integral with or beneath polishing pad 28. The end point detection probes can be optical sensors, resistance probes, or the like, depending, in part, on the composition of the surface that is being polished. Although illustrated as being integral with or beneath the polishing pad, the end point detection probes can also be otherwise positioned relative to the polishing pad and the surface being polished.

During a CMP operation, the carrier head and semiconductor wafer are set in motion relative to the polishing pad. In a preferred CMP operation the carrier head and semiconductor wafer are caused to rotate about the axis of the carrier head as indicated by arrow 34. This motion can be either continuous or can be an oscillatory back and forth motion. At the same time that the carrier head is rotating, the polishing pad can also be set in motion. Preferably the polishing pad motion is an orbital motion. Also during the CMP operation, a polishing slurry is delivered to the interface between the polishing pad surface and the surface of the semiconductor wafer. The slurry can be delivered, for example, through openings in the polishing pad. The slurry usually contains an abrasive material as well as chemicals selected for their reactivity with the material on the surface of the semiconductor wafer. FIG. 2 illustrates, in plan view, a polishing pad 28 and one possible positioning of a plurality of end point detection probes. Three end point detection probes 31, 32, and 33 are spaced 120° apart in this exemplary embodiment. Preferably the three end point detection probes are spaced at different distances from the center of the polishing pad. For example, for a CMP apparatus for the polishing of a 300 mm wafer, probe 31 can be about 20 mm from the center of the polishing pad, probe 32 can be about 80 mm from the center, and probe 33 can be about 120 mm from the center of the polishing pad. Also illustrated is a plurality of slurry delivery openings 34. The slurry delivery openings are uniformly distributed over the surface of polishing pad 28.

The mechanical abrasion of the material on the surface of the semiconductor wafer combined with the chemical interaction of the slurry with that material removes a portion of the material from the surface and produces a surface having a predetermined profile, usually a planar surface. The removal rate of material from the surface of the semiconductor wafer is proportional to the polishing pressure and the relative velocity between the surface of the semiconductor wafer and the polishing pad. The localized removal rate, $RR(x)$, can be expressed as $RR(x)=k(x)*P(x)*V(x)$ where $k(x)$ is a coefficient depending on the slurry used, the distribution of slurry, and a number of other factors, $P(x)$ is the polishing pressure, $V(x)$ is the relative velocity, all as a function of position on the semiconductor wafer surface, and * indicates multiplication. There is thus a plurality of adjustable process variables that influence the localized polishing rate.

In the processing of a semiconductor wafer to manufacture integrated circuits or other semiconductor devices there are a number of steps in which a layer of insulating material, metal, or other material is formed on at least one surface of the wafer by chemical vapor deposition, physical vapor deposition, plating, or the like (each of which will be hereinafter be referred to without limitation as "deposition"). Following such a deposition step, it is often desirable to planarize or otherwise configure the surface of the wafer including such layer of deposited material. Hereinafter such configuration of the surface will be referred to as "polishing." The incoming wafer that is to be polished generally has a non-uniform surface. That is, the wafer itself or the layer of material that has been deposited on the surface of the wafer has a non-uniform thickness. To achieve the desired (usually planar) final polished surface, the CMP operation must be performed in a substantially non-uniform manner taking into consideration both the initial variation of material thickness across the wafer surface and the desired final profile. The initial pre-CMP distribution of material thickness and the desired post-CMP thickness determine the required spatial distribution of CMP polishing rate and hence the required setting of the adjustable CMP process variables.

The incoming semiconductor wafer thickness non-uniformity is generally a characteristic of the processing equipment used to produce the surface to be polished. For example, if the semiconductor wafer has a layer, such as a layer of copper, deposited on the wafer surface, the thickness distribution of that deposited layer will be characteristic of the equipment used to deposit that layer. The deposition equipment, for example, may typically deposit layers that are relatively thicker in the middle and at the edge, but thinner between the middle and the edge. If a lot of semiconductor wafers is to be polished in a CMP apparatus, and if the semiconductor wafers in that lot have just been processed in the same deposition apparatus, each wafer in the lot likely will have the same general incoming thickness non-uniformity characteristic of the deposition apparatus. In accordance with an embodiment of the present invention, information gained in polishing one wafer of the lot, and especially end point detection information, may advantageously be used as feedback information to adjust processing variables in polishing the next wafer of the lot.

Figure 4:
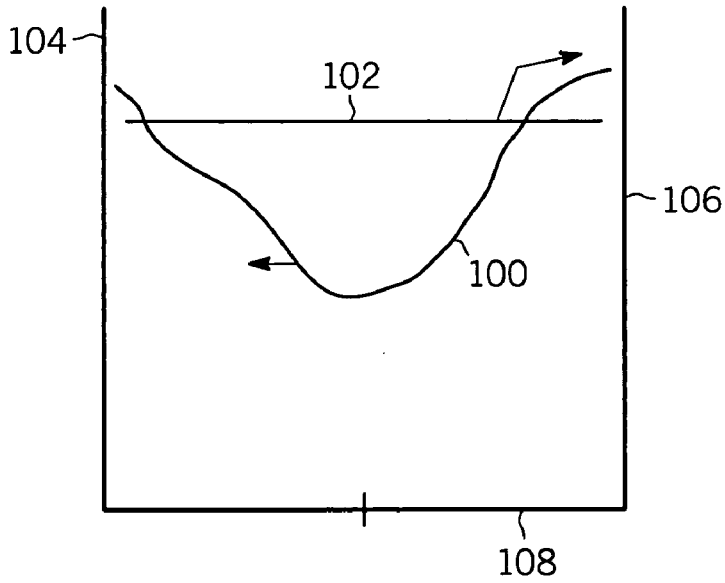
FIG. 4 illustrates graphically a representative incoming thickness profile and an estimated removal rate profile.

In accordance with one embodiment of the invention, the surface of a work piece can be polished to achieve a desired final surface profile such as, for example, a planar surface. The method of the invention is illustrated, in flow chart form, in FIG. 3. For ease of explanation, but without limitation, the method of achieving the desired profile will be explained as it applies to polishing the surface of a layer that has been deposited overlying a semiconductor wafer. Further, the method will be explained as it applies to a CMP apparatus in which the polishing pad is placed in orbital motion relative to the carrier head and in which the carrier head and the wafer are rotating about the axis of the carrier head. Those of skill in the art will understand that the method may be applied to the polishing of surfaces of work pieces other than semiconductor wafers, with or without deposited layers thereon, and may also be applied to other CMP apparatus designs having other polishing pad and carrier head motion. Initially the pre-CMP thickness profile of the deposited layer on the incoming wafer is obtained (step 40). The thickness profile may be obtained by actual measurement of the thickness of the layer, by estimation from the know characteristics of the deposition equipment, or the thickness profile may even be assumed to be essentially flat with some approximate average thickness. The next step is to obtain or estimate the expected removal rate profile for the polishing of the deposited layer on the incoming wafer (step 42). The expected removal rate profile is dependent on the settings of the many process variables of the multi-variable CMP apparatus such as the pressure in each of the plenums, the speed of rotation of the carrier head, the speed and magnitude of the orbits of the polishing pad, the composition and delivery of the polishing slurry, and the like. The setting of these process variables will be referred to as the "initial process variable settings." The removal rate profile for the initial process variable settings may be know from previous qualifications done on the particular CMP apparatus or it may be estimated. The removal rate profile may even be assumed to be flat with some estimated average removal rate value. FIG. 4 illustrates an actual representative incoming thickness profile 100 and an expected removal rate profile 102. In this illustrative figure the removal rate profile has been estimated to be flat. Left vertical axis 104 is in units of thickness and right vertical axis 106 is in units of thickness per unit time. Horizontal axis 108 is in units of distance measured both left and right from the center of the wafer.

Turning again to FIG. 3, a predicted clearing time profile is calculated by simulating an end point detection algorithm (step 44). By "clearing" is meant the removal of the layer by the polishing operation. The clearing time profile thus indicates the time at which the layer is removed as a function of radial position x on the wafer. The clearing time profile, CT(x), is calculated by dividing the incoming deposition profile, g(x) by the estimated removal rate profile, RR(x). Usually the incoming deposition profile is first adjusted by some constant amount. That is $CT(x)=(g(x)-\delta)/RR(x)$, where $\delta$ is some remaining thickness of the incoming layer at which the polishing begins to satisfy the clearing condition. The value of $\delta$ is a parameter in the end point detection algorithm, and, in accordance with one embodiment of the invention, is typically set to a value of about 10–20 nm. An example of an end point detection algorithm, in accordance with one embodiment of the invention, is an algorithm used with an optical end point detection system. Such end point detection algorithms are well known in the art. A similar, though different, algorithm would be used with other end point detection systems. According to an optical end point detection algorithm, light emitted by an end point detection probe is reflected off the surface of the wafer as it is being polished. The spectrum of the light reflected from the surface during the polishing operation is analyzed and is compared with an initial baseline reflected light spectrum obtained at the beginning of the polishing operation. Depending on some known optical tuning parameters of the algorithm and the analysis of the spectrum, the algorithm makes the decision whether the clearing condition has been accomplished or whether some amount of material remains to be polished. As a specific example, when polishing a copper film, the film becomes transparent to the light emitted by the probe at a thickness of about 10–20 nm. The algorithm does not necessarily require all probe samples to satisfy the clearing condition before the decision is made that the end point of the polishing operation has been reached. For example, in polishing a copper layer on the semiconductor wafer, the decision may be made that the end point has been achieved when 80–90% of the probe samples satisfy the tuning parameters and report a clear condition. The percentage selected for the decision point is dependant on properties of the product being fabricated on the wafer being polished, such properties including, for example, the density of copper lines remaining on the wafer. In order to remove the remaining 10–20 nm of material, the actual end point is not recognized and the polishing operation is not terminated until after some additional time delay. The length of the additional time delay can be a variable parameter in the end point detection algorithm.

Figure 5:
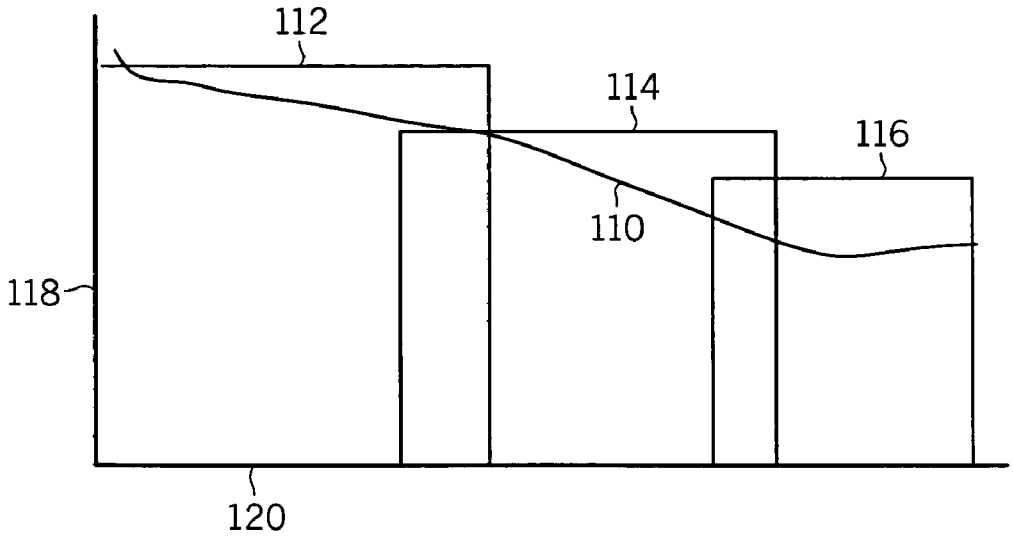
FIG. 5 illustrates graphically a clearing time profile as well as the expected probe detection times for three end point detection probes.

Further in accordance with the embodiment of the invention, expected probe detection times are calculated for each of the plurality of end point detection probes. The expected probe detection times are calculated based on the predicted clearing time profile and the probe coverage area. Because the end point detection probes are moving (in this illustrative embodiment) in an orbital pattern with respect to the wafer and the wafer itself in rotating, each end point detection probe is not measuring a fixed spot on the wafer. Therefore, in accordance with an embodiment of the invention, the minimum and maximum radial positions or range of each end point detection probe during a polishing operation (step 46) are determined. The maximum and minimum radial positions (on either side of the wafer center) can be defined as $(-R_{max}, -R_{min})$ and $(R_{max}, R_{min})$ where R is the radial distance measured from the center of the wafer. Within the intervals between the maximum and minimum radial positions for each probe, the minimum value of the predicted probe detection time is determined for each end point detection probe step 48). By the definition of clearing time profile, at the determined minimum probe detection time values none of the probes will detect a clearing condition. In accordance with one embodiment of the invention, clearing time is defined to be the time at which at least a predetermined percentage of the samples taken by the particular probe detect clearing. The predetermined percentage can be, for example 80–90% of the end point detection probe readings, where the percentage is determined in accordance with the end point detection algorithm. From the minimum values of predicted probe detection time determined in each of the intervals between the maximum and minimum radial positions, detection times at which the predetermined percentage of end point detection probes will report a clearing condition is calculated. This calculation can be done, for example by using either a sequential search or a binary search using the minimum value for the predicted clearing time in the maximum-minimum-radial position of each probe as a starting point. For example, in a sequential search, some small discrete amount of time (~0.1 sec) is added to the previously evaluated time. For the portion of the clearing profile within the region defined by the ($-R_{max}$, $-R_{min}$) and ($R_{max}$, $R_{min}$) radial position of the probe, the relative portion of the profile with values less than the reference amount, is calculated. The time is incrementally increased until the relative portion of the profile becomes less than 80–90%. Again, the range of 80–90% is dependent on the particular algorithm being used. In accordance with one embodiment of the invention, a fixed delay is added to the calculated minimum probe detection time to calculate an end point detection event time. The fixed delay accounts for an over etch or over polish that insures clearing of all portions of the layer across the wafer. FIG. 5 illustrates graphically a calculated predicted clearing time profile 110 as well as the expected probe detection times 112, 114, and 116 for three end point detection probes. Vertical axis 118 is in units of time and horizontal axis 120 is in units of radial position to the left of the center of the wafer. A similar graph would apply for the radial positions right of center.

The process variables of the multi-variable CMP apparatus are set to the initial process variable settings (step 50) and the layer of material on the semiconductor wafer is polished (step 52) using those initial process variable settings. The end point detection probes are monitored during the polishing operation and the actual probe detection time, the time when each probe registers the end point of the polishing operation, is measured (step 54). The measured end point detection times are compared to the expected end point detection times for each of the end point detector probes. FIG. 6 illustrates, in bar graph form, a comparison of possible results for each of three end point detection probes. Vertical axis 121 is in units of time. Bars 122 and 124 illustrate expected and measured end point detection times, respectively, for a first end point detection probe 31; bars 126 and 128 illustrate expected and measured end point detection times, respectively, for a second end point detection probe 32; and bars 130 and 132 illustrate expected and measured end point detection times, respectively, for a third end point detection probe 33.

In accordance with an embodiment of the invention, a time correction coefficient, $K_i$, relating actual measured end point detection probe detection time to expected end point detection probe detection time is calculated for each of the plurality of end point detection probes (step 56). The time correction coefficient is defined as $K_i=(T_{measured})_i/(T_{expected})_i$, where the subscript i indicates the identity of the end point detection probe. The time correction coefficients can then be used together with the predicted clearing time profile to construct an actual removal rate profile (step 62). To calculate the actual removal rate profile, a continuous time correction coefficient K(x) is created (step 60) from the discrete time correction coefficients $K_i$. The continuous time correction coefficient can be calculated by calculating the probability that a sample will be taken within a specific radial range R, R+dR. This probability is calculated based on the kinematics of the particular CMP apparatus being employed and on the particular settings for the process variables on that apparatus. For example, if the CMP apparatus is an orbital CMP apparatus, the wafer undergoes a number of motions relative to the pad: orbital motion, rotational motion, and angular oscillation motion. The kinematics of the CMP operation depend on the parameters governing these motions such as orbiting radius, orbiting speed, wafer rotation speed, angular oscillation range, oscillation speed, and upper-to-lower head offset (the offset of the axis of the carrier head with respect to the center of the polishing pad). The combination of these parameters affects the area on the wafer covered by a probe, and, indirectly, the probability of sampling at the specific location within the area. These parameters and their effect will vary depending on the particular type of CMP apparatus being employed. FIG. 7 illustrates graphically a radial distribution of end point detection probe sampling density for a particular CMP apparatus and for a particular set of operating parameters for that CMP apparatus. In this figure vertical axis 141 indicates the number of samples recorded and horizontal axis 143 indicates position along a radius of the wafer being polished from the center of the wafer (left edge of graph) to the right edge of the wafer (right edge of the graph). Line 144 indicates the counts recorded by end point detection probe 31, line 146 indicates the counts recorded by end point detection probe 32, and line 148 indicates the counts recorded by end point detection probe 33. If there is an overlap of coverage of two end point detection probes, for example as indicated at 150 and 152 in FIG. 7, the probability indicates the relative significance of the two time correction coefficients. For example, if the time correction coefficient for one end point detection probe is equal to 1.1, the time correction coefficient for a second end point detection probe having overlapping coverage is 0.9, and at a point of overlap the two end point detection probes have the same statistical probability, then the resulting time correction coefficient for that location is 1.0. More generally, the time correction coefficient K(r) is given by $$K(r)=\Sigma S_i(r)*K_i/\Sigma S_i(r)$$

where $S_i(r)$ is the significance of the probe i at the point (r). If none of the end point detection probes cover a particular point, the time correction coefficient for that point is calculated as an extrapolated or interpolated value between neighboring valid points. FIG. 8 illustrates graphically a continuous time correction coefficient K(x) 180. Also indicated in FIG. 8 is the radial distribution of end point detection probe sampling density, as seen before, and the discrete time correction coefficients 182, 184, 186 of the three end point detection probes 31, 32, and 33, respectively. Vertical axis 188 for time correction is unit-less, vertical axis 189 is in units of probability density, and horizontal axis 190 is in units of radial position on the wafer.

Having the continuous time correction coefficient profile, K(x), it is then possible, in accordance with an embodiment of the invention, to construct an actual removal rate profile (step 62):

$$RR_{actual}(x)=RR_{predicted}(x)/K(x)$$

where in the interval (0, $+X_{max}$) K(x)=K(r) and in the interval ($-x_{max}$, 0), K(−x)=K(r). FIG. 9 illustrates graphically an actual removal rate profile 200 reconstructed in this manner. Also shown in the figure is the original estimated removal rate profile 102. As before, vertical axis 104 is in units of removal rate and horizontal axis 108 is in units of radial position across the wafer.

The reconstructed removal rate profile can be used, in accordance with an embodiment of the invention, as a feedback for run to run process control (step 64). The reconstructed removal rate profile of the previous wafer is used to adjust the variable process parameters of the multi-variable CMP apparatus for the polishing of the next wafer. The adjustment of the variable process parameters is done on the basis of the polishing performance on the previous wafer and the pre-CMP surface profile of the next wafer. For the next wafer to be polished, the same process is followed as with the just polished wafer except that one or more of the process variables is changed, if necessary, based on the previous polishing results. For example, based on the polishing results, it may be determined that the pressure in one or more of the plenums should be changed, the orbital speed of the CMP apparatus polishing pad should be changed, or the like. For example, knowing that the removal rate in a CMP operation is proportional to the relative linear velocity between wafer and polishing pad (in addition to other factors), the actual removal rate can be corrected, in part, by making adjustments to the orbiting speed. Further, by observing the reconstructed removal rate profile, indicating the removal rate as a function of position along a radius, appropriate changes can be made in the pressure distribution in the plurality of pressurized concentric plenums.

While at least one exemplary embodiment has been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing the exemplary embodiments. It should be understood that various changes can be made in the function and arrangement of elements without departing from the scope of the invention as set forth in the appended claims and the legal equivalents thereof.

What is claimed is:

1. A method for controlling a chemical mechanical polishing (CMP) operation in a multi-variable CMP apparatus that includes a plurality of end point detection probes, the method comprising the steps of:

obtaining a thickness profile of a first layer overlying a first work piece;

estimating an expected removal rate profile for the first layer;

calculating a predicted clearing time profile for the first layer based upon the thickness profile and the expected removal rate profile;

determining an expected range of radial position for each of the plurality of end point detectors during a CMP operation;

calculating an expected probe detection time for each of the plurality of end point detection probes based on the clearing time profile and the expected range of radial position;

setting each variable of the multi-variable CMP apparatus to a first setting;

polishing the first layer overlying the first work piece;

measuring an actual probe detection time for each of the plurality of end point detection probes;

calculating a time correction coefficient relating actual probe detection time to expected probe detection time for each of the plurality of end point detection probes; and constructing an actual removal rate profile based on the expected removal rate profile and the calculated time correlation coefficients.

2. The method of claim 1 further comprising the steps of:

obtaining a thickness profile of a second layer overlying a second work piece;

setting each variable of the multi-variable CMP apparatus to a second setting in response to the step of constructing an actual removal rate profile and obtaining the thickness profile of the second layer; and polishing the second layer overlying the second work piece with each variable of the multi-variable CMP apparatus set to the second setting.

3. The method of claim 2 wherein the step of setting each variable of the multi-variable CMP apparatus to a second setting comprises the step of setting each variable of the multi-variable CMP apparatus to a second setting in which the second setting is different than the first setting with respect to at least one variable.

4. The method of claim 1 wherein the step of obtaining a thickness profile comprises the step of selecting a value from a list consisting of a measured profile and a profile representative of the equipment used to deposit the first layer.

5. The method of claim 1 wherein the step of calculating a predicted clearing time profile comprises the step of dividing the thickness profile by the expected removal rate profile.

6. The method of claim 1 wherein the step of calculating a predicted clearing time profile comprises the step of dividing the thickness profile less a constant factor by the expected removal rate profile.

7. The method of claim 1 wherein the step of calculating a time correction coefficient comprises the step of dividing the actual probe detection time for each of the plurality of end point detection probes by the expected probe detection time for each of the plurality of end point detection probes.

8. The method of claim 7 further comprising the step of extrapolating the results of dividing to create a continuous spatial function of time correction coefficient.

9. A method for controlling a chemical mechanical polishing (CMP) operation on a layer overlying a surface of a work piece in a CMP apparatus having a plurality of settable process variables and a plurality of end point detection probes, the method comprising the steps of:

estimating an expected removal rate profile for a first layer overlying a first work piece;

setting the plurality of process variables to a first setting;

determining an expected end point detection time for the first layer for each of the plurality of end point detection probes;

polishing the first layer with the plurality of process variables set to the first setting;

measuring an actual end point detection time for the first layer for each of the plurality of end point detection probes; and constructing an actual removal rate profile for the first layer based on the expected removal rate profile, the expected end point detection time for each of the plurality of end point detection probes, and the actual end point detection time for each of the plurality of end point detection probes.

10. The method of claim 9 further comprising the steps of:

obtaining a profile of a second layer overlying a second work piece;

setting at least one of the plurality of process variables to a second setting in response to the step of constructing an actual removal rate profile for the first layer; and polishing the second layer with at least one of the plurality of process variables set to the second setting.

11. The method of claim 10 wherein the step of setting at least one of the plurality of process variables comprises the step of setting at least one of the plurality of process variables to a second setting different than the first setting.

12. The method of claim 11 further comprising the step of constructing an actual removal rate profile for the second layer.

13. The method of claim 12 wherein the step of constructing an actual removal rate profile for the second layer comprises the steps of:

estimating an expected removal rate profile for the second layer overlying the second work piece;

determining an expected end point detection time for polishing the second layer for each of the plurality of end point detection probes;

measuring an actual end point detection time for polishing the second layer for each of the plurality of end point detection probes; and calculating the actual removal rate profile for the second layer based on the expected removal rate profile for the second layer, the expected end point detection time for polishing the second layer, and the actual end point detection time for polishing the second layer.

14. A method for controlling a chemical mechanical polishing (CMP) operation in a CMP apparatus having a plurality of end point detection probes and in which a plurality of process variables can be set to adjust the removal rate across a layer that is to be polished, the method comprising the steps of:

setting the plurality of process variable to a first setting;

determining an expected end point detection response from each of the plurality of end point detection probes;

polishing a first layer on a first work piece with the process variables set to the first setting;

observing an actual end point detection response from each of the plurality of end point detection probes;

determining a difference between the expected end point detection response and the actual end point detection response;

adjusting at least one of the plurality of process variables to a second setting; and polishing a second layer overlying a second work piece with the plurality of process variables set to the second setting.

15. The method of claim 14 further comprising the step of calculating a time correction coefficient equal to the actual end point detection response divided by the expected end point detection response for each of the plurality of end point detection probes.

16. The method of claim 15 further comprising the step of constructing an actual removal rate profile based on the calculated time correction coefficients.

17. The method of claim 16 wherein the step of adjusting at least one of the plurality of process variables comprises the step of adjusting at least one of the plurality of process variables in response to the actual removal rate profile.

18. A method for controlling a chemical mechanical polishing (CMP) operation in a CMP apparatus having a plurality of end point detection probes and in which a plurality of process variables can be set to adjust the removal rate across a layer that is to be polished, the method comprising the steps of:

obtaining an incoming profile for a first surface of a first work piece to be polished;

calculating an expected clearing time profile based on the incoming profile for the first surface;

calculating an expected end point detection response for the plurality of end point detection probes in response to the expected clearing time profile;

polishing the first surface of the first work piece;

observing an actual end point detection response for the plurality of end point detection probes as the first surface of the first work piece is polished; and constructing a removal rate profile for the first surface of the first work piece based on differences between the expected end point detection response and the actual end point detection response.

19. The method of claim 18 further comprising the steps of:

obtaining an incoming profile for a second surface of a second work piece to be polished;

adjusting at least one of the plurality of process variables to a second setting in response to constructing a removal rate profile; and polishing the second surface using the second setting.

20. The method of claim 19 further comprising the step of constructing a removal rate profile for the second surface of the second work piece.

21. A method for controlling a chemical mechanical polishing (CMP) operation in a CMP apparatus having a plurality of end point detection probes and in which a plurality of process variables can be set to adjust the removal rate across a layer that is to be polished, the method comprising the steps of:

setting the plurality of process variables to a first setting;

polishing a first layer overlying a first work piece to remove the first layer using the first setting for the plurality of process variables;

collecting information from the plurality of end point detection probes;

evaluating the information from the plurality of end point detection probes to determine removal rate of the first layer across the first work piece;

adjusting the plurality of process variables to a second setting in response to evaluating the information; and polishing a second layer overlying a second work piece using the second setting for the plurality of process variables.

* * * * *